United States Patent [19]

Owen et al.

[11] Patent Number: 4,827,694

[45] Date of Patent: May 9, 1989

[54] FILM FOLDING DEVICE, METHOD, AND PRODUCT

[75] Inventors: Dave L. Owen, Wellford; Robert E. Jahn, Greer, both of S.C.

[73] Assignee: W. R. Grace & Co.-Conn., Duncan, S.C.

[21] Appl. No.: 175,889

[22] Filed: Mar. 31, 1988

Related U.S. Application Data

[62] Division of Ser. No. 101,234, Sep. 25, 1987.

[51] Int. Cl.[4] ..... B65B 11/18

[52] U.S. Cl. ..... 53/441; 53/464; 53/556; 53/223

[58] Field of Search ..... 53/226, 228, 556, 441, 53/465, 464, 230, 232, 233, 222, 223, 224

[56] References Cited

U.S. PATENT DOCUMENTS

| | | | |
|---|---|---|---|
| 3,220,160 | 11/1965 | Roberts | 53/233 |
| 4,078,363 | 3/1978 | Ranzi | 53/228 |
| 4,548,024 | 10/1985 | Fine | 53/556 |
| 4,574,564 | 3/1986 | Pester | 53/556 X |

*Primary Examiner*—John Sipos

*Attorney, Agent, or Firm*—John J. Toney; William D. Lee, Jr.; Mark B. Quatt

[57] ABSTRACT

Disclosed herein is a machine for wrapping filled trays in thermoplastic film, said machine having a film folding device in which the side folding arms and back folding bar move along linear paths in synchronized motion so that the points of coincidence between the back folding bar and the side folding arms define a curve which approximates a diagonal to the tray being wrapped. This film folding device provides uniquely smooth folds on the bottom of a tray which can be readily heat sealed to produce a relatively leakproof package.

8 Claims, 7 Drawing Sheets

FIG.9
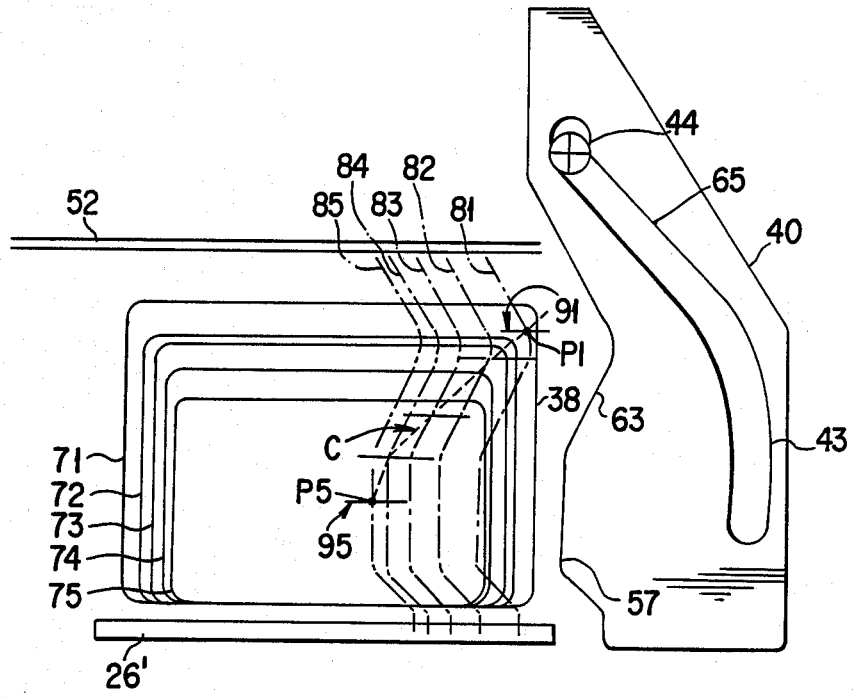
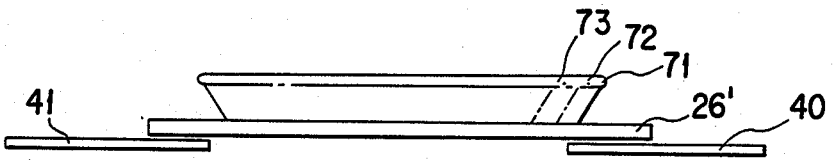
FIG.10

FIG. 11
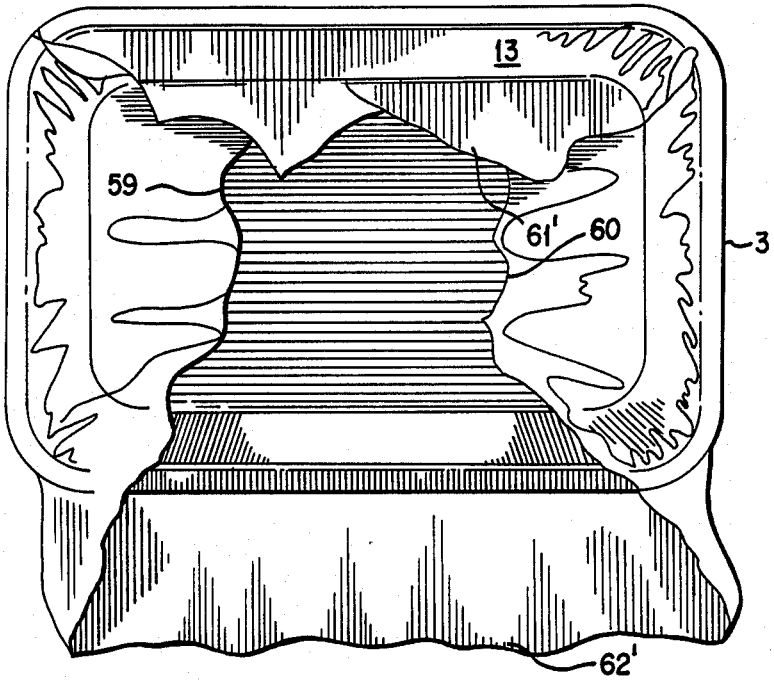
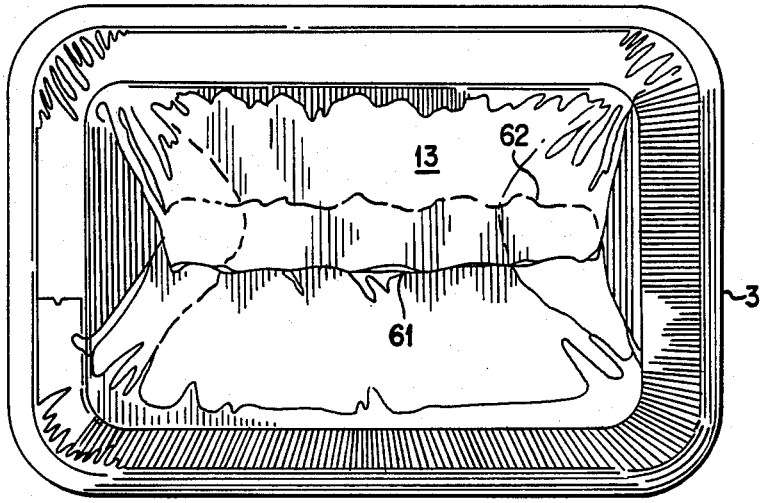
FIG. 12

FILM FOLDING DEVICE, METHOD, AND PRODUCT

FIELD OF THE INVENTION

This is a divisional application of application Ser. No. 101,234, filed on Sept. 25, 1987.

This invention relates to an apparatus and method for wrapping a tray filled with a product in a sheet of wrapping material such as thermoplastic film and to the package produced by the method. In particular, the invention relates to a film folding device for folding a sheet of plastic film smoothly under the tray so that it can be heat sealed securely to itself.

BACKGROUND OF THE INVENTION

In grocery stores, supermarkets, and butcher shops a paper pulp or polystyrene foam tray with a meat, cheese, or poultry product therein and overwrapped by a sheet of plastic film is a very familiar package. Often these packages are wrapped manually with the film folded or tucked under the bottom of the tray and the tray is then passed over a hot plate to seal it. In order to increase production and lower labor costs, automatic wrapping devices have been introduced. Typical of these is the apparatus described in U.S. Pat. No. 4,631,903 which issued on Dec. 30, 1986 to Yoshiyuki Takamura.

One of the drawbacks in both hand wrapping and in the prior automatic machinery processes is that the film is not folded smoothly under the bottom of the tray. When this occurs and there is a "bunching" of the film underneath the tray. Additional time must be taken to seal the thick bunch of film so that a package can be made that will maintain its integrity throughout the distribution cycle. In addition, such seals usually will not result in a leakproof package so that fluids from the meat or poultry product will leak through the seals thus presenting an unsightly package which will often be rejected by the shopper. Accordingly, it is one object of the present invention to provide a device and method for producing a smooth, leakproof seal on the underside of a tray.

In order to produce packages which secure the product within the package so that it will not unnecessarily move around and also to produce a neater and more attractive package, often a heat shrinkable film is used to overwrap a tray filled with a meat or poultry. Unless a secure seal is produced on the bottom side of a tray when the film is shrunk, the seal will pull apart. Accordingly, it is another object of the present invention to provide a secure seal on the underside of the tray that will withstand shrinking tension.

A further object of the invention is to provide a method and apparatus for packaging with a full range of tray sizes without having to adjust or change the folding arms.

Yet another object of the present invention is to provide packages with smoother seals on the bottom thereof for easier handling, stacking, and display.

Still another object of the present invention is to provide a package which requires a minimum amount of film.

These and other objects of the present invention will be readily appreciated by reference to the summary of the invention, drawings appended hereto, and the detailed description which follow.

SUMMARY OF THE INVENTION

In one aspect, the present invention is a film folding device for use in an apparatus for wrapping a generally rectangular tray filled with a product in a sheet of thermoplastic film or the like which comprises means for draping or stretching a sheet of film over a filled tray with the edges of the sheet being below the tray; linearly moveable side folding arm means for folding the sheet under the sides of the tray; linearly moveable back folding bar means for folding film under the back of the tray as the film is folded under the sides of the tray; means mounted above the tray for advancing the tray; and, horizontally stationary folding means positioned to fold the film under a front edge of the tray as it is advanced by the advancing means.

In another aspect, the present invention is an improvement in an apparatus for wrapping a tray filled with a product in a sheet of thermoplastic film of the like, the improvement being a film folding device for folding film under the tray comprising means for holding a sheet of film horizontally above the tray; means for lifting the tray into the film while the tray is so held, the film being draped or stretched around all sides of the tray when the tray is lifted to its highest position; a back folding bar mounted parallel to the back edge of the tray for reciprocal linear motion towards and under the tray to fold the film against the back underside of the tray, said back folding bar being above the film while the film is so held; a pair of folding arms mounted to move linearly towards and under the tray but above the film simultaneously with the back folding bar to fold the film against the underside of the sides of the tray; a straight edge on the side of each folding arm adjacent the tray, said straight edge being parallel to the adjacent tray edge and said straight edge extending in length for a substantial portion of the length of the adjacent tray edge, said straight edge being disposed to contact the draped film immediately before contact of the film by the back folding bar; a horizontally stationary front folding bar mounted parallel to the front edge of the tray and above the film; and, means for moving the tray forward from the lifting means after the film has been released from the holding means, the side arms have folded the film under the sides, and the back bar has folded the film under the back of the tray whereby when said tray is moved forward the front folding bar folds the film under the front underside of the tray to complete the wrapping of the tray. The film folding device preferably further includes a cam slot in each folding arm, said slots being arranged so that for a portion of the length of the slots a cam follower moving linearly in each slot will drive the arms toward each other at right angles to the direction of the motion of the cam followers; a cam follower mounted in each slot for travel therein, each cam follower being fixed to said back folding bar whereby as said bar is advanced toward the tray, the folding arms move simultaneously towards the tray. Preferably, the folding arms of the film folding device further comprise a gathering edge, said gathering edge extending from the straight edge in the direction towards the rear of the tray and sloping away from the tray, the slope of said gathering edge and position of said cam slot being chosen so that the back folding bar and the gathering edge coincide at a point which is approximately below the adjacent back corner of the tray. In addition, it is preferred that the position of the cam slots and slope of the gathering edge is chosen so that as the back folding bar is advanced the points of coincidence of the gathering edge and the bar define a gathering curve that will approximate a line drawn from the back corner of the tray to its center, in other words, the gathering curve will approximate a portion of a diagonal of the tray.

In still another aspect, the present invention is a method of wrapping a filled tray in thermoplastic film and folding the film underneath the tray, the method including the steps of stretching, draping, and holding a sheet of film over the tray and around and below the sides of the tray; providing a pair of side folding arms, a back folding bar, and a front folding bar; folding the sheets under the sides of the tray by moving the side arms along a linear path towards each other while folding the sheet under the back side of the tray by moving the back bar along a linear path under the tray while the film is held around the tray in a stretched condition, said side arms and back bar being moved so that the points of coincidence between the back bar and the side arms follow approximately the diagonals of the tray; and moving the tray across the front folding bar to fold the film under the front side of the tray thereby enclosing the tray. Preferably, the method includes the use of a heat sealable film and a step of applying heat to the folded film under the tray to seal the film to itself. In one embodiment the film may be a heat shrinkable film and include the step of applying heat to the film to shrink it. In another embodiment the front folding bar may be lowered before and as the tray is moved across it.

In yet still another aspect of the invention, the invention is the product produced by the method described in the foregoing paragraph.

DESCRIPTION OF THE DRAWINGS

Appended hereto and made a part of this disclosure are drawings which are illustrative of the invention but not limiting on its scope. In the drawings:

FIG. 9 is a partial top plan layout showing various tray sizes illustrating the gathering curve of the present invention;

FIG. 10 is a front elevation view of the layout in FIG. 9;

FIG. 11 is the underside of a tray with the sides of the sheet of film folded inwardly and the back fold at one stage of being folded and the front fold has not been folded; and FIG. 12 is a view of FIG. 11 with the front film fold folded over the back fold so that the package is ready for sealing.

DETAILED DESCRIPTION

The apparatus in which the film folding device of the present invention preferably is utilized will be described first and then the method of operation will be described.

Figure 1:
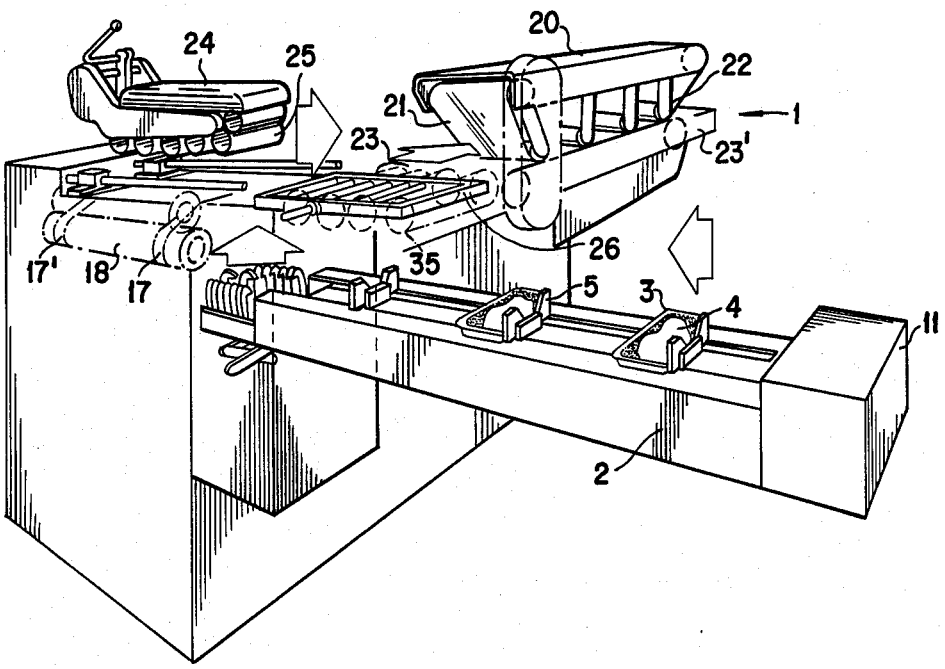
FIG. 1 is a perspective representation of an apparatus which includes the present invention showing essential parts with nonessentials removed.
Figure 2:
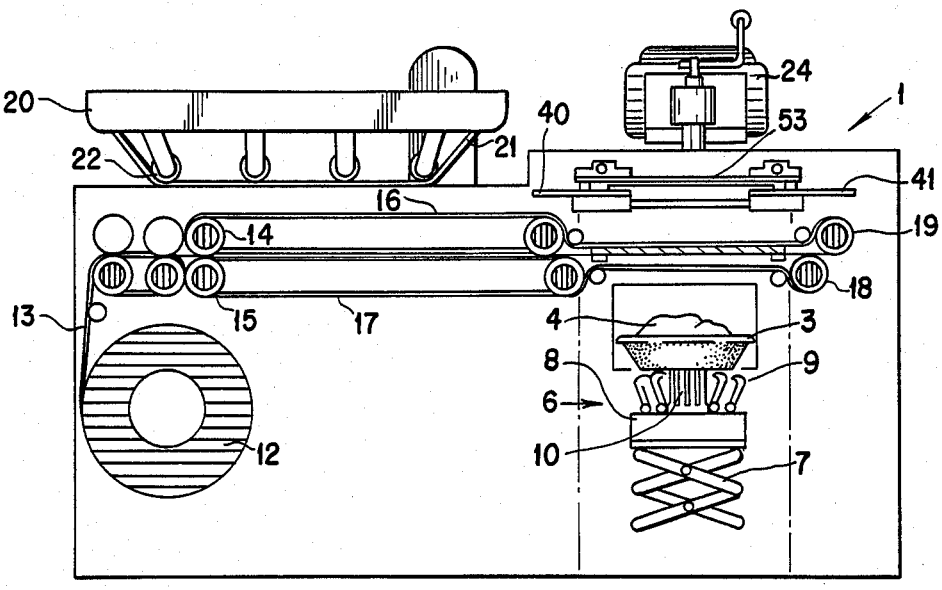
FIG. 2 is a schematic elevation from behind the machine looking forward in the direction the product travels as it leaves the folding device of the present invention.

Looking first at FIG. 1, wrapping machine 1 is shown in perspective with parts and panels removed so that the working mechanisms may be seen. Arrows represent the flow of product, namely, a meat or poultry product 4 carried in tray 3 on in-feed conveyor 2 which is driven by the main machine drive (not shown) and supported at one end within cover 11. Each filled tray 3 is spaced on the conveyor 2 by index member 5 as it moves to the elevator station 6. In FIG. 2, the tray 3 is shown at the elevator station 6 resting on moveable support fingers 9 and balanced by stationary support fingers 10. The support fingers 9 and 10 are carried by platform 8 which is lifted and lowered by lifting mechanism 7. Throughout this detailed description, reference will be made to required parts and a description will be given of their operating features. Description of items such as the main machine drive, other drive motors, switches, gears, etc. is omitted as such details can readily be supplied by those skilled in the art using this specification as a guide and will not be described where such description is not necessary for an understanding of the present invention. Representative of prior art machines with various operating mechanisms is the aforementioned U.S. Pat. No. 4,631,903 which issued on Dec. 30, 1986 to Yoshiuki Takamura and is assigned to Fugi Pak System Limited of Japan. The Takamura patent is incorporated herein be reference.

Continuing with the description of the apparatus shown in FIGS. 1 and 2, wrapping film is fed from roll 12 and is gripped by and guided by lower belts 17 and 17' and upper belts 16 and 16' which hold the edges of the film therebetween. The lower belts 17 and 17' can be seen in FIG. 1 being carried by lower roller 18 and the upper roller 19 with corresponding belts 16 and 16' has been removed for viewing purposes. In this position the film is tightly held between the film transfer belts 16, 16' and 17, 17' horizontally above the filled tray 3.

It should be noted that the apparatus as described basically works on indexed or intermittent motion. The infeed conveyor 2 moves a product into elevator station 6 and then stops until the function at the elevator station has been completed. Likewise, when the tray 3 has been placed on the support fingers 10 at the elevator station the film transfer belts operate to transfer and hold a sheet of film over the filled tray 3. By means not shown, the sheet is severed from the roll in an appropriate length. In the present apparatus, these mechanisms are all controlled by a timing camshaft which, as it rotates, actuates the various drive mechanisms in the proper sequence. It is also within the skill of the art to substitute for the timing camshaft a microprocessor to actuate and stop each drive mechanism in programmed sequence.

Still viewing FIGS. 1 and 2 at the point where the film sheet 13 has been positioned above the tray 3, it should be noted that, in general, any flexible wrapping material in sheet form can be used with the present invention but preferably the wrapping material will be thermoplastic film which is heat sealable. These types of films are readily available in the marketplace and are well known to those skilled in the packaging arts and are usually films formed from polyethylene, ethylene homo- or copolymers, e.g., ethylene-propylene copolymers and ethylene-vinyl acetate copolymers, linear low density polyethlyenes, very low density polyethylenes, polyvinyl chlorides, and polyvinylidene chlorides, and various copolymers and blends of any of the foregoing polymers. In many instances it is desirable that the film be stretchable so that as the product is forced or lifted into the film or the film is draped and stretched down over the tray the film will give and stretch. The foregoing listed films can be compounded to have these types of properties which can be selected to meet various packaging needs. In addition, for some applications it is desirable that the film also be heat shrinkable. Films of the foregoing listed polymers are available which are both stretchable for the packaging process and then after the package has been formed these can be heated to heat shrink the film tightly around the product for handling and appearance purposes. Some of the films are multi-layer films having layers of one or more of the aforementioned polymers and may even include a gas barrier layer, if, for packaging the particular product such a property is desirable.

With the tray 3 located at station 6 and film sheet 13 positioned above it, tray 3 will be lifted by the actuation of the lifting mechanism 7 in the direction of the arrow in FIG. 1 upwardly to a position above the film transfer belts 16 and 17 and upwardly of the forwarding arms 40 and 41. The folding arm opertion will be described in greater detail hereinafter. Once the film has been folded under the bottom of the tray 3 the tray is advanced towards transfer conveyor 35 by product advancing apparatus 24 which has resilient product or package grippers 25 incorporated therewith. The product advancing apparatus 24 acts intermittently and as it removes the product from the fingers 10 the folding operation is completed. When the product is delivered onto the transfer conveyor 35 which is a series of vertically moveable belts between the rollers of conveyor 26 to carry a tray 3 perpendicularly off the exit roller conveyor 26 and place tray 3 on belt conveyor 23 which is a Teflon belt that is heated by heaters concealed within the housing 23. As the wrapped package now moves onto the heated Teflon belt 23 and the pressing conveyor belt 21 holds the package down and presses it against the belt so that the underside of the tray containing the folds of the film firmly contacts the belt, the film will be heated to heat seal the folds together as the package travel from one end of station 20 to the other with the constant pressure on belt 21 being applied by the resilient hold down rollers 22.

Figure 3:
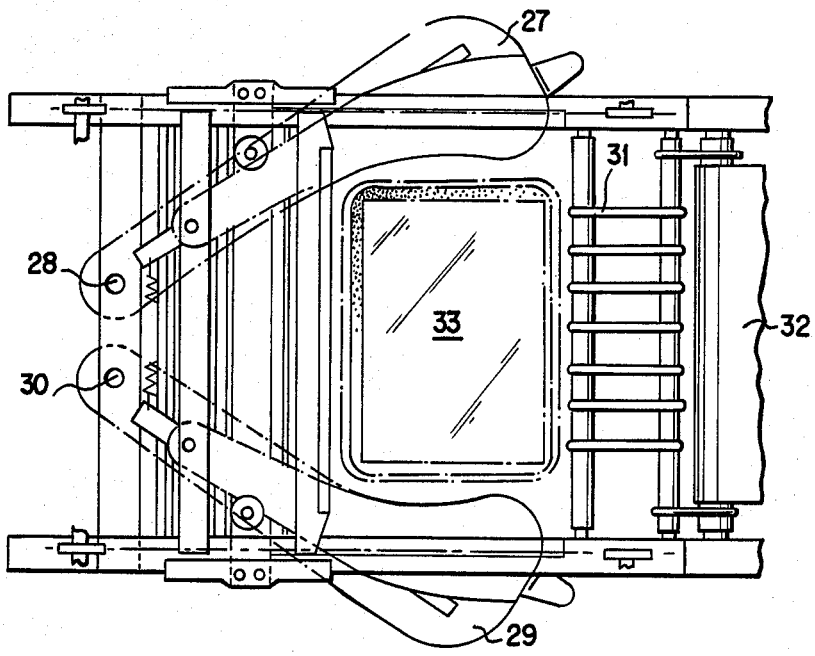
FIG. 3 PRIOR ART
FIG. 3 shows the arrangement of a typical prior art film folding device.

Now, turning to the film folding device of the present invention which is shown in FIGS. 4 through 9 in different stages of operation and detail, attention is directed first to FIG. 3 which shows a prior art device wherein the folding arms 27 and 29 are pivotally mounted at pivots 28 and 30 and move in arcuate motion to fold the film under the tray 33. This tray of arcuate motion tends to bunch the film under the tray in an uneven manner and this bunching effect is sometimes also called "roping". As can be envisioned, the arcuate or swinging type of arms of the prior art tend to act like a human hand grabbing and gathering the film and trying to bunch or "stuff" the film under the tray. Obviously, the uneven bunching when sealed leaves many folds and crevices which are unsealed through which leakage can take place; or, where incomplete and unsatisfactory sealing has taken place the film may even detach from the bottom of the tray.

Figure 4:
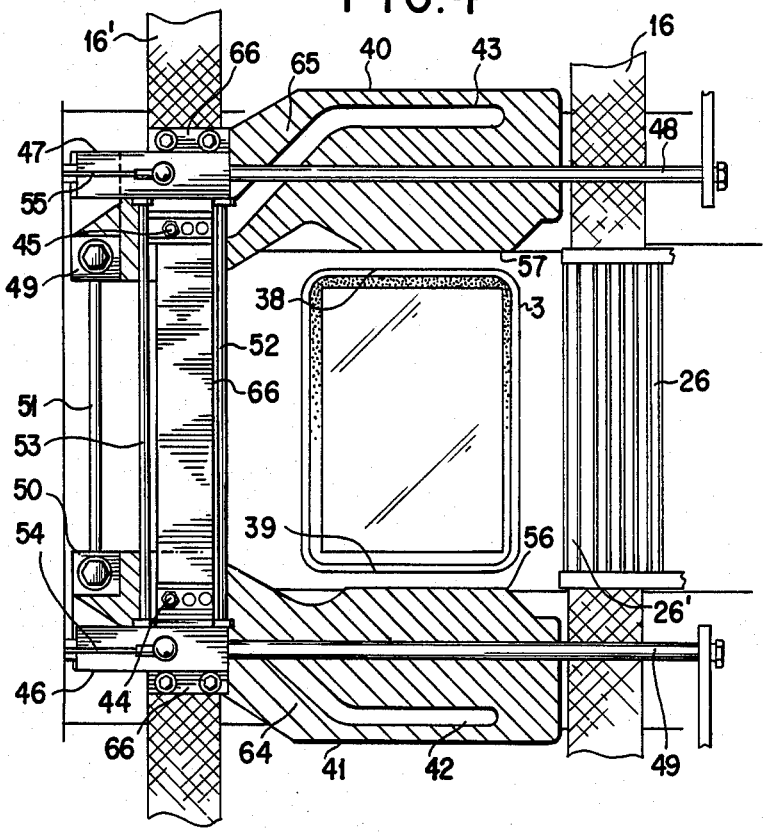
FIG. 4 is a top plan view layout of a preferred embodiment of the present invention showing a tray in position for wrapping.

Looking now at FIG. 4 the top plan layout shows the preferred embodiment of the present invention with the folding arms 40 and 41 being crosshatched, not to show a section through them, but, rather, to emphasize their unique shape. In FIG. 4 the folding arms 40 and 41 which are the side folding arms are shown each having a straight edge surface 56 and 57 which these edge surfaces parallel to the sides of the tray 38 and 39. Each of the arms 40 and 41 is provided with a synchronizing cam slot 42 and 43 in which cam follower assemblies 44 and 45 travel. The folding arms 40 and 41 are slideably supported by mounting bearings 49 and 50 which are journaled on shaft 51. As is apparent, this mounting requires that the arms 40 and 41 can move only in a linear direction directly towards each other and away from each other and the arms cannot move on a curved path.

Still referring to FIG. 4, cam follower assemblies 44 and 45 are mounted on plate 66 with pusher rod assemblies 46 and 47 and support back folding bar 52 and balance bar 53. Pusher rod assemblies 46 and 47 are slideably mounted on guide shafts 48 and 49. The pusher rod assembly is driven in reciprocal motion by drive rods 54 and 55 which, preferably, are the connecting or drive rods driven by the timing camshaft (not shown). Alternately, pneumatic cylinders which are double acting could be used to drive pusher rod assemblies 54 and 55 in reciprocal motion.

Figure 6:
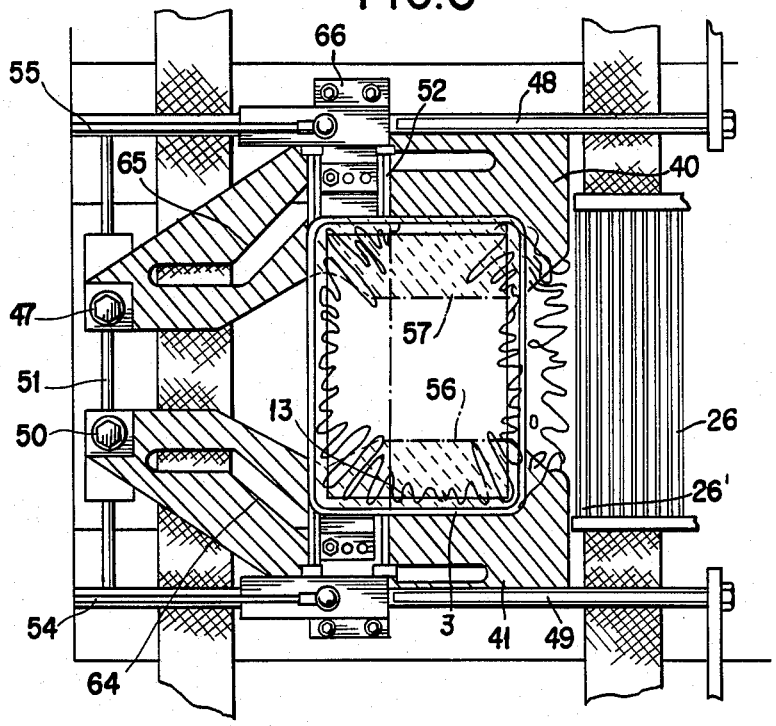
FIG. 6 is the top plan layout showing the folding of the film under a tray.
Figure 7:
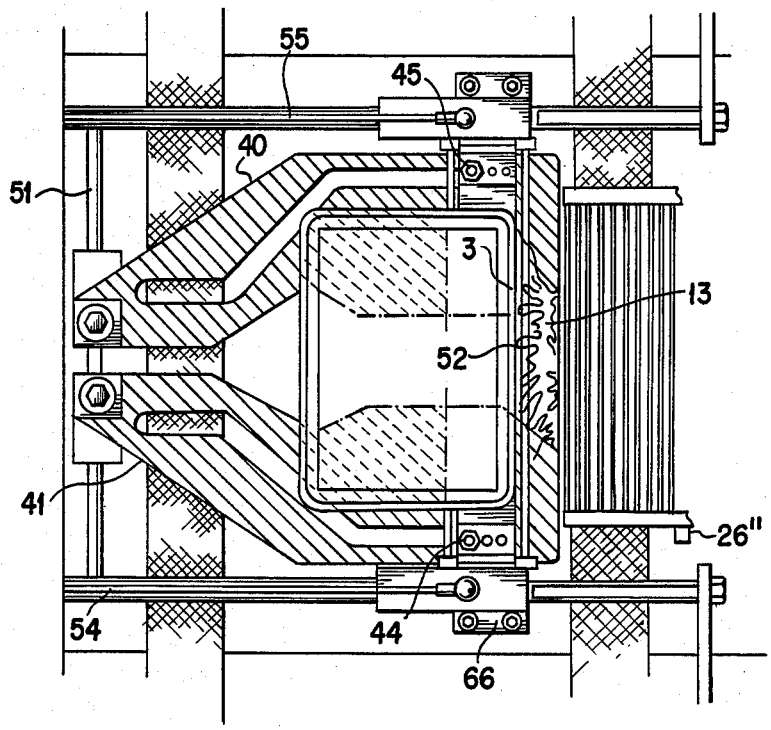
FIG. 7 is the top plan layout of FIG. 6 showing the film folding device and its position as the folding operation has been completed.

As can be appreciated by viewing FIGS. 6 and 7, when the drive rods 54 and 55 are actuated, the roller cam followers will be moved forward to a position shown in FIG. 6 and then to the position shown in FIG. 7. In doing this, the cam followers have moved along the sloped portions of the cam slots 64 and 65 which motion causes the cam followers to force the folding arms 40 and 41 to being to close to the position shown in FIG. 6. Further movement of the drive rods 54 and 55 will bring the side folding arms 40 and 41 to their position shown in FIG. 7 under the tray 3 which is still in its original position on support 10. As the side arms have closed from their open position in FIG. 4 to the closed position in FIG. 7 the back folding bar 52 has simultaneously moved foward to the intermediate position in FIG. 6 and then to the final position in FIG. 7.

Figure 5:
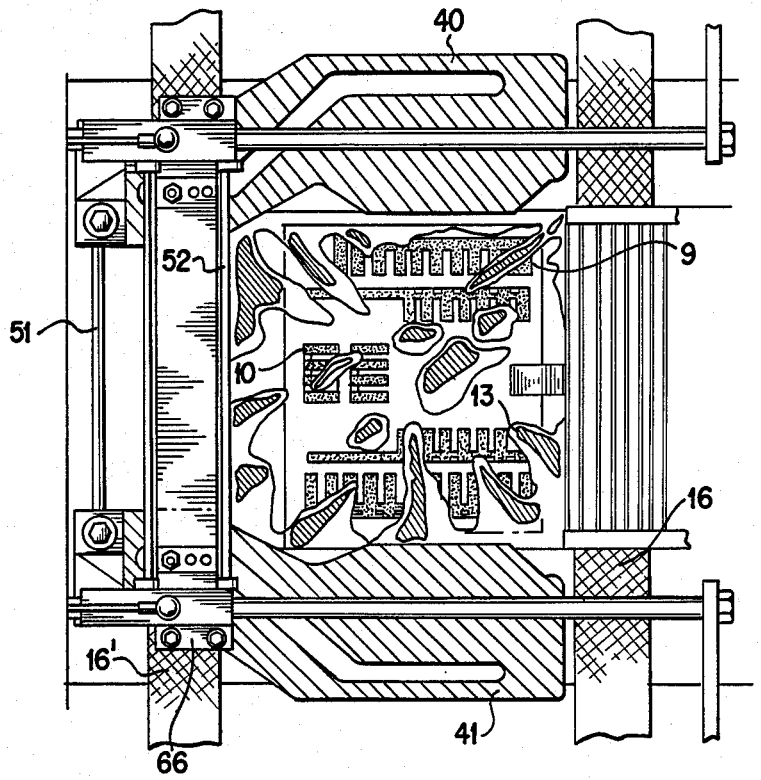
FIG. 5 is the same view as FIG. 4 but without the tray in place and showing the film held over the lifting platform.

Also shown in FIG. 4 are the upper film transfer belts 16 and 16' which are the belts which in conjunction with corresponding belts 17 and 17' (FIG. 1) hold a sheet film at the elevator station 6. The sheet of film 13 is shown in FIG. 5 in which the tray is not present as it is FIG. 4 and the top view of the moveable support fingers 10 and stationary fingers 9 can be seen in this view. The film is gripped securely on all four sides so that when the tray 3 is lifted above the folding arms 40, 41 and bar 52, the film is stretched tightly and held ready for the folding operation while held in this stretched condition.

Figure 8C:
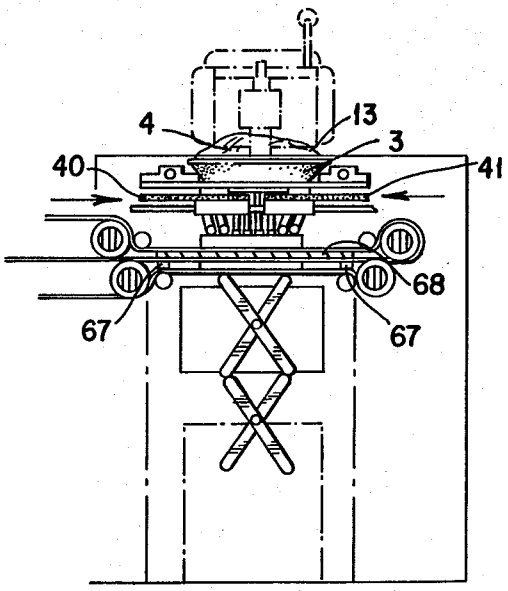
FIG. 8 in views (a), (b) and (c) shows a filled tray being lifted into a sheet of film as the folding arms begin their folding process.
Figure 8B:
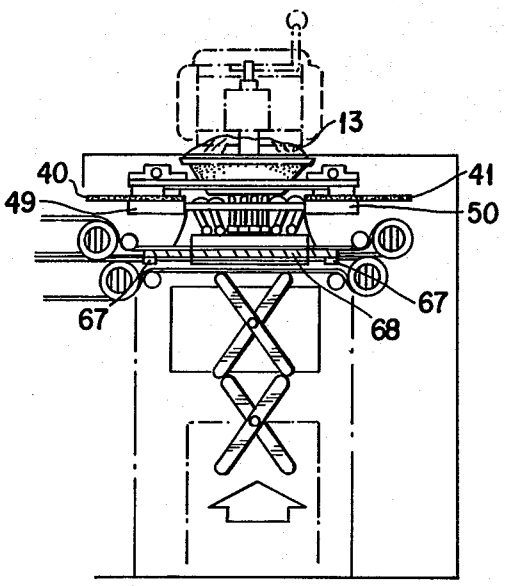
Figure 8A:
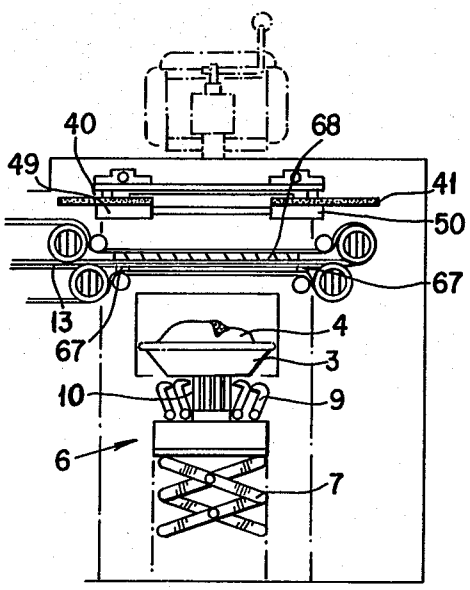

Looking now at the preferred operation of a film folding device according to the present invention, in FIG. 4 in FIGS. 8A to 8C filled tray 3 is in position to be wrapped at station 6. The tray is lifted up into the film which stretches somewhat as the tray is raised and as can be seen from FIGS. 1, 2, and 8 the tray will be raised all the way in the position of FIG. 4 and 8C until it contacts the resilient grippers of product advancing apparatus 24. At this point the bottom of the tray 3 will be above the folding arms 40 and 41 and also above back folding bar 52. The film is held by film grippers 67 which press the film against guide plates 68. While in this position, the drive rods 54 and 55 will advance thus moving the backing bar 52 forward and simultaneously closing the folding arms 40 and 41 as shown in FIG. 6. The folding arms 40 and 41 begin the side folding immediately ahead of the folding by the back folding bar as shown in FIGS. 6 and 8C so that the folds on the tray underside have the appearance of the folds in FIG. 11 where the side folds 59 and 60 have been folded inwardly and the back fold 61' is being folded by back folding bar 52. Holding the film taut while the folding process begins allows the film to be laid smoothly onto the underside of the tray as there is no "slack" or excess film to wrinkle. The film is held at the position shown in FIG. 6 but released before the FIG. 7 position. The function of the difference in height of fingers 9 and 10 can now be appreciated. The height difference provides clearance for the folding arms and bars under the tray as they spread the film onto the underside of the tray.

In FIG. 7 the arms 40 and 41 have closed all the way and the back flap 61 is being laid against the bottom of the tray by the motion of the back folding bar 52. At the same time, the package advancing apparatus 24 is actuated so that the resilient package grippers 25 move the tray forward and the still unfolded flap 62 encounters roller 26' as the tray leaves the position in FIG. 7. As the tray moves and is advanced to the exit roller conveyor 26 the front flap 62 is folded under by action of horizontally stationary front folding bar 26' which is also the first roller in the exit roller conveyor set 26. The entire set of rollers in exit roller conveyor 26 is mounted to rock or dip by tilt means 26" so that front bar 26' and the immediately following rollers are lower than the tray 3 as it is advanced by apparatus 24. When the conveyor 26 is lowered towards the advancing product, the folding by back bar 52 has been completed as the tray 3 tilts onto the lowered conveyor 26. Thus, the back fold is applied smoothly and is completd before the front fold is completed. Now, as the tray advances past bar 26' the front fold is completed. This dipping or lowering of the roller conveyor 26 also exposes the belts in the right angle or perpendicular transfer conveyor 35 whose belts operate between the rollers of roller conveyor 26 to transfer the package at right angles in the direction of the arrow in FIG. 1 on to the heated Teflon sealing conveyor belt 23. These belts are now actuated. The completed folds on the bottom of the tray have a neat, smooth appearance as shown in FIG. 12 and they are ready for heat sealing. After sealing, the resulting package will be leakproof providing a very desirable package for retail display.

Considering now significant details of the shape and operation of the folding arms and the back folding bar, reference will be made to FIGS. 9 and 10. FIG. 9 shows a partial plan view in simplified form of folding arm 40 with cam slot 43, cam follower 44, back folding bar 52, and front folding bar 26'. Trays of varying sizes are illustrated stacked one on top of the other with the smallest being on top and the largest on bottom to demonstrate the applicability of the film folding device of the present invention to a wide range of tray sizes and also to show the path of the the gathering curve, C. The trays as shown are all centered with their front edge adjacent and positioned just above the front folding bar 26'. The largest size tray which is on the bottom will have a dimension of about $10\frac{5}{8}''$ in length by $8\frac{1}{2}''$ in width and will be about $1\frac{3}{8}''$ high. The smallest tray will have a length of about $8\frac{1}{4}''$, a width of $5\frac{3}{4}''$, and a height of $1\frac{1}{4}''$. The trays are represented by numerals 71, 72, 73, 74, and 75, 75 being the smallest tray.

The positions of the folding arm as it moves in linear motion from right to left are represented by the various dotted lines 81, 82, 83, 84, and 85. The points of coincidence between the back folding bar 52 and the sloping or gathering edge 63 of the folding arm 40 are represented by points $P_1$ through $P_5$. Points $P_2$, $P_3$, and $P_4$, are not labeled because of space limitations in the drawing. However, the horizontal line at each point represents the position of the back folding bar 52 at the point of coincidence with edge 63. The sloped portion or cam surface 65 of cam slot 43 is chosen so that the slope of the slot will drive the folding arm 40 whereby the edge 63 will coincide with the bar 52 at approximately the corner of the tray 71. The slope of edge 63 and the positioning and motion of bar 52 together with the slope of surface 65 provide coincidence approximately at the corner of each of the trays. This roughly traces a diagonal from the corner to the center of the trays and the curve is designated as the gathering curve C. The lines 91 through 95 which are the horizontal positions of the back folding bar show the progress of the bar as it moves and folds the film under the tray and defines the points of coincidence. It should be also noted that the edge 57 of the folding arm is parallel to the edge of the tray 38. It has been surprisingly discovered that having the gathering curve approximately diagonal or a gathering curve which roughly goes through the corners of the tray to be wrapped will contribute significantly to smooth folding of the film. The shape of the gathering arms required to provide such a curve has been discovered trying many shapes and that shown represents the optimum discovered. In operation, the edge 57 first encounters the film and almost simultaneously the back folding bar 52 begins to fold the back fold underneath the back side of the tray so that in this partially folded position the underside of the tray appears as shown in FIG. 11. Once the folding operation has been properly begun by the side folding arms and back folding bar, the remaining folding takes place as described previously.

Although the present invention has been described through specific terms, it is to be noted here that the described embodiment is not exclusive and various changes and modifications may be imparted thereto without departing from the spirit of the invention and the scope thereof which is limited solely by the appended claims.

We claim:

1. In an apparatus for wrapping a generally rectangular tray filled with a product in a sheet of thermoplastic film or the like, a film folding device comprising:

(a) means for draping and holding a sheet of film over the tray with the edges of the sheet being below the tray;

(b) linearly moveable side folding arm means for folding the sheet under the sides of the tray while the tray is stationary;

(c) means mounted above the tray for forwardly advancing the tray from said side holders;

(d) linearly moveable back folding bar means for folding film under the back of the tray as the film is folded under the sides of the tray;

(e) horizontally stationary folding means positioned to fold the film under the front edge of the tray as it is advanced by the advancing means; said means for vertically displacing said folding means so that it may be lowered to tilt the tray as it passes there over to allow completion of the back fold before the front fold is completed.

2. In an apparatus for wrapping a tray filled with a product in a sheet of thermoplastic material by holding the sheet horizontally and either lifting the tray into the film or lowering the film down onto the tray to stretch and drape the film down and around the sides of the tray and then to fold the film under the tray with folding arms prior to advancing the tray to a position where the folded film under the tray will be heat sealed, an improved film folding device comprising:

(a) a side folding arm on each side of the tray, said arms being linearly moveable from a open position to a closed position underneath the tray thereby folding film underneath the sides of the tray while the tray is stationary;

(b) means for forwardly advancing the tray from said side folding arms;

(c) a back folding bar moveable linearly to a position underneath the tray to fold film on the back underside of the tray;

(d) the points of coincidence between the back folding bar and the folding arms as they move simultaneously under the tray following approximately the diagonals of the tray; and (e) a front folding bar which is horizontally stationary but vertically displaceable; and, (f) means for lowering said front folding bar as the tray is moved across it by said advancing means to fold film on the underside of the front of the tray.

3. In the method of wrapping a filled tray in thermoplastic film and folding the film underneath the tray, the improved method comprising the steps of:

(a) stretching, draping, and holding a sheet of film over the tray and around and below the sides of the tray;

(b) providing a pair of side folding arms means for forwardly moving said wrapped tray from said side folding arms; a back folding bar, and a front folding bar;

(c) folding the sheet under the sides of the tray while the tray is stationary by moving the side arms along a linear path towards each other while (d) folding the sheet under the back side of the tray by moving the back bar along a linear path under the tray, said side arms and back bar being moved so that the points of coincidence between the backing bar and the side arms follow approximately the diagonals of the tray;

(e) releasing the held film before the respective arms have completed folding the film underneath the tray; and, (f) moving the tray with said moving means across the front folding bar while lowering the front folding bar as the tray is moved across it to fold the film under the front side of the tray thereby enclosing the tray.

4. The method of claim 3 including the step of providing straight edges on each of said folding arms, said straight edges being parallel to the sides of the tray.

5. The method of claim 3 wherein the film is heat sealable.

6. The method of claim 3 including the step of applying heat to the underside of the tray to seal the folded film to itself thereby sealing the tray within the film.

7. The method of claim 6 wherein the film is also heat shrinkable.

8. The method of claim 3 including the step of applying heat to the film to seal same underneath the tray.

* * * * *